United States Patent [19]

Bethlen

[11] 4,023,849

[45] May 17, 1977

[54] STRETCHER TROLLEYS

[75] Inventor: Farkas Bethlen, Richmond, England

[73] Assignee: G. D. Searle & Co., High Wycombe, England

[22] Filed: Oct. 6, 1975

[21] Appl. No.: 619,800

[30] Foreign Application Priority Data

Oct. 8, 1974 United Kingdom ..... 43568/74

[52] U.S. Cl. ..... 296/20; 5/62; 280/640

[51] Int. Cl.[2] ..... A61G 1/02

[58] Field of Search ..... 296/20, 19; 5/62, 68; 280/640

[56] References Cited

UNITED STATES PATENTS

| | | | |
|---|---|---|---|
| 3,644,944 | 2/1972 | Bourgraf | 296/20 |
| 3,820,838 | 6/1974 | Limpach | 296/20 |

*Primary Examiner*—Joseph F. Peters, Jr.
*Assistant Examiner*—John A. Carroll
*Attorney, Agent, or Firm*—John J. Kolano; John A. Dhuey

[57] ABSTRACT

A stretcher trolley wherein the height and angle can be adjusted is described herein.

1 Claim, 5 Drawing Figures

STRETCHER TROLLEYS

The present invention relates to stretchers, stretcher trolleys, beds and similar supports on which a patient may be carried, and more particularly to a novel design of stretcher trolley the height and angle of which is adjustable.

In many circumstances, a conventional stretcher trolley cannot be used, for example, if the terrain over which it is to travel is too rough, and the stretcher alone must be carried. In other circumstances, for medical reasons, it is desirable that a stretcher trolley be tilted to raise the feet of a patient above his head and conventional trolleys for this purpose are generally extremely complex. It may also be desired, to have a stretcher trolley, the height of which is adjustable.

The present invention provides a novel stretcher trolley which may be carried as a conventional stretcher or wheeled as a conventional stretcher trolley. It further can be adjusted to any height between that of a conventional stretcher on the ground to that of a conventional stretcher trolley and may further be positioned at various angles to the horizontal. In this respect the present stretcher-trolley may be used as a temporary or permanent bed, the height and angle of which is adjustable.

For the purpose of the present invention the term "stretcher" includes any generally flat platform on which a patient may be carried free of the ground. The term "trolley" includes any device on which a stretcher may be carried and transported manually and includes trolleys incorporating motor drive mechanisms. The term "stretcher trolley" includes any combination of a stretcher and a trolley, and will include rolling beds for the temporary or permanent management of patients.

According to one aspect of the present invention there is provided a stretcher trolley comprising a patient support member, and a framework adapted to raise and lower the support member while maintaining the support member horizontal.

According to a second aspect the present invention provides a stretcher trolley comprising a patient support member and a framework having means for tilting one end of the support member relative to the other end. Thus the patient support member may be movable from a position a substantial distance above the floor or ground to a position in which it lies, for example 18'' above the ground. In this position the stretcher trolley can be carried and used as a stretcher. In the lowered position 18'' above the ground the trolley can be moved directly into an ambulance and the patient transferred to another support in the ambulance or kept on the existing support.

The trolley may only be lowered to, for example, 24'' above the ground, and the patient is then appropriately positioned for X-ray purposes.

The framework may include means for tilting the end of the support member opposite to the said one end so that a patient's head or feet may be raised or lowered.

The framework may comprise a frame for receiving the support member, and two pairs of struts articulated about horizontal axis to the frame, one pair being articulated on one side of the transverse centre-line of the frame and the other pair being articulated on the other side of said centre-line. Extensible arms may be connected between at least one strut of each pair and the frame.

The support member for the patient may be based, in its simplest form on a rectangular frame of suitable dimensions to carry or support a patient laying upon it. Attached to each end of the frame are handles with which the support member may be lifted and pushed. The body of the patient is then held upon straps or canvas laid across the support frame. Alternatively the support member may consist of a flat sheet of metal plastic or similar material held rigid by a rectangular framework and having handles attached at both ends. In both cases a mattress may be provided upon the support member for the comfort of the patient.

Suitable rolling devices such as wheels or multi-directional castors may be attached to the framework upon which the stretcher trolley may be wheeled. In circumstances in which multi-directional castors are used to give more flexibility of movement, three such castors may be mounted on a triangular carriage and the carriage attached to the frame by hinging means. By this arrangement the castors retain a fixed angle to the ground as the stretcher trolley is raised and lowered.

Two embodiments of the invention will now be described by way of example with reference to the accompanying drawings, of which:

Figure 1:
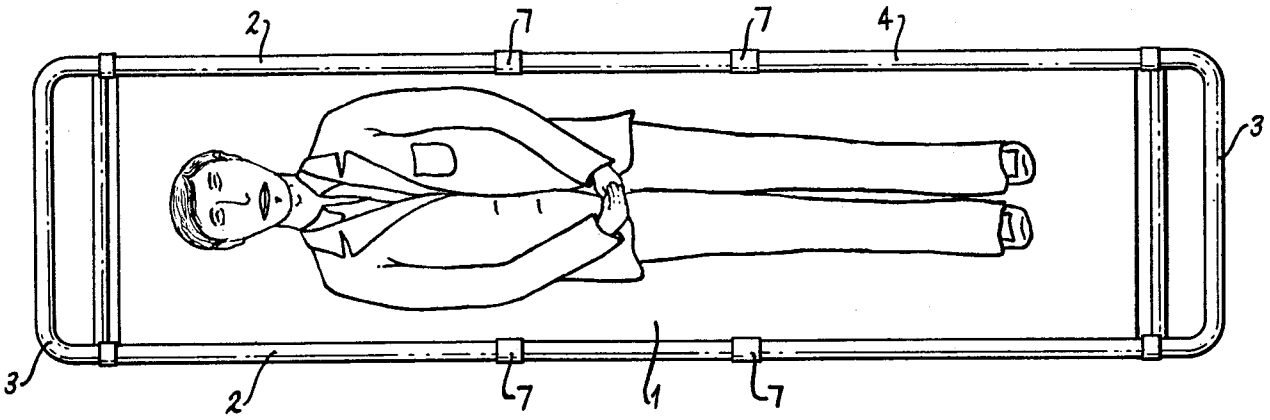
FIG. 1 is a plan view of a stretcher trolley with a patient thereon.

The stretcher trolley shown in FIGS. 1 to 4 includes a stretcher portion 1 compising a rectangular frame 2 of tubular steel, the ends 3 of which form handles for the stretcher portion. A flat plate 4 is attached to the frame 2 by means of arcuate members 4 and which engage, either permanently or releasably, the longer sides of the frame 2. A mattress (not shown) rests on the plate 4 and a patient is laid on the matress.

Figure 2:
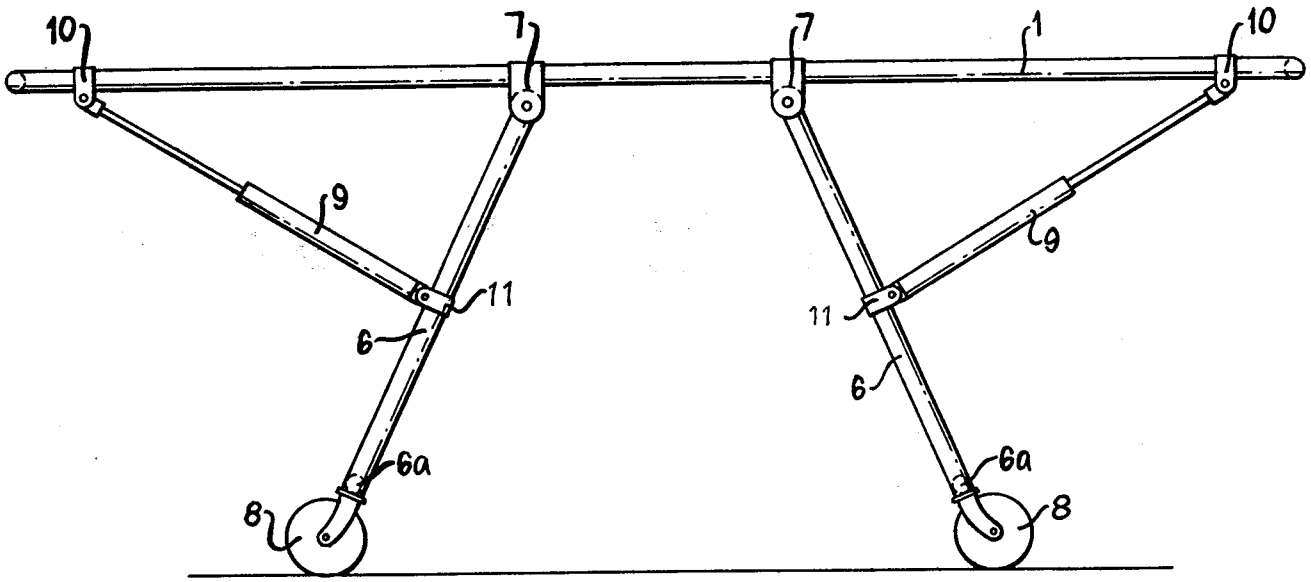
FIG. 2 is a side view of the stretcher trolley of FIG. 1 in an extended position.
Figure 3:
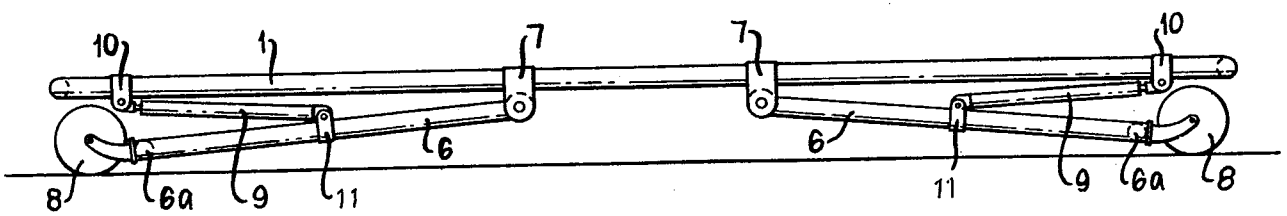
FIG. 3 is a side view of the stretcher trolley of FIG. 1 in a folded position.
Figure 4:
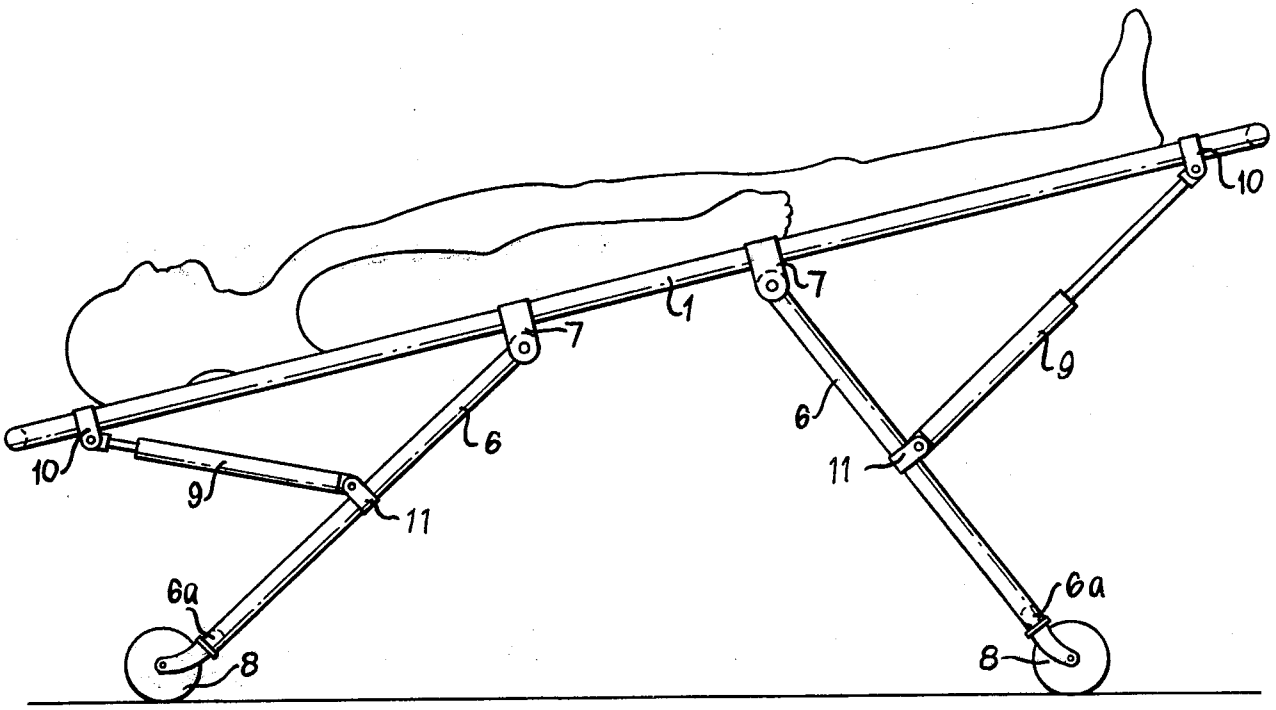
FIG. 4 is a side view of the stretcher trolley of FIG. 1 with the stretcher tilted.

The stretcher trolley also includes a trolley portion which can be seen in FIGS. 2 to 4 and which comprises four struts 6, two being pivotally connected at one end to each long side of the rectangular frame 2 by means of brackets 7. the brackets 7 are situated adjacent the centre of each long side of the frame 2 and are fixed relative thereto. A wheel 8 is connected to the other end of each strut 6 to permit the stretcher trolley to be wheeled in the conventional manner. Transverse members **6*a* extend from the lower end of each strut 6 on one side of the frame 2** to the corresponding strut on the opposite end.

Gas springs 9 are pivotally connected at one end to brackets **9*a* rigid with the struts 6 and positioned approximately mid-way between the brackets 7 and the wheels 8. The other end of each gas spring 9 is pivotally connected to a respective bracket 10 adjacent the end of the longer sides of the frame 2. The gas springs are pneumatic devices capable of adjustment to any length, within limits, and having means for fixing their length once a desired length has been achieved. A lever (not shown) may be used to adjust and fix the length of the gas spring. In the present embodiment the arrangement is such that the pair of gas springs at each end of the frame operate in unison. The degree of adjustment of the gas springs is such that they can contract from the position shown in FIG. 2 to that of FIG. 3 in which the support is 6″ above the ground.**

When the stretcher trolley is in the position shown in FIG. 2 it may be used as a conventional trolley.

FIG. 3 shows the stretcher-trolley in a folded position in which the gas springs 9 are fully compressed and the wheels 8 and frames 6 are folded under the support. In this position the stretcher trolley may be carried as a conventional stretcher under conditions where a trolley is unsuitable.

FIG. 4 shows a stretcher trolley in which the pairs of springs 9 are extended by different amounts thereby tilting the support in the manner shown. In this position the patient may be transported or positioned for treatment.

Figure 5:
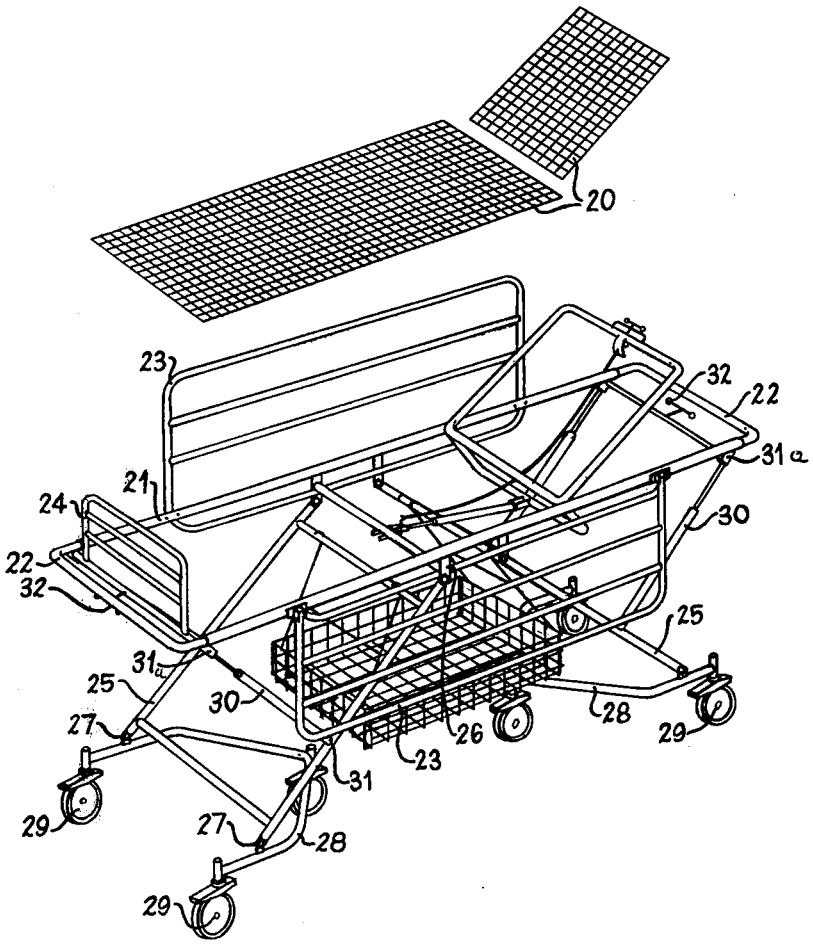
FIG. 5 is an exploded perspective view of a modified stretcher trolley.

FIG. 5 shows a more complex stretcher trolley embodying the present invention. The stretcher portion of the stretcher trolley has a substantially rectangular frame 21 of tubular steel to which webbing 20 can be attached in order to support the patient. The ends of the frame 21 form handles 22. Side bars 23 and end bars 24 are attached to the frame 21 and prevent the patient falling off the stretcher portion. The bars may be raised or lowered as can be seen from FIG. 5.

The trolley portion of the stretcher trolley comprises two generally rectangular frames 25 of tubular aluminum which are pivotally attached at one end to the frame 21 by means of brackets 26 at positions either side of the centre-line of the frame 21. At the other end, the frames 25 are pivotally attached by means of brackets 27 to wheeled carriage frames 28. The carriage frames 28 are of generally triangular configuration and are mounted on swivelling wheels 29.

Gas springs 30 are pivotally attached at one end to the sides of the frames 25 by means of brackets 31 and at the other end to the frame 21 by brackets 31*a*. Each pair of gas springs attached to one frame 25 is activated by levers 32, thereby allowing tilting of the frame 21. Upon operating the lever, the height and angle of the frame 21 may be altered and then fixed by subsequently releasing the levers. The gas springs are of such dimensions and are so positioned that the frames may be fully extended, thereby constituting a conventional stretcher trolley, or folded against the support. In the present embodiment the stretcher trolley is not of a type to be carried manually but may be folded down for example for placing in an ambulance.

It will be appreciated that various modifications may be made to the embodiments described without departing from the scope of the invention claimed. For example, the framework may have no wheels if the trolley is to be used in a permanent location but preferably the framework has wheels or sliders at one end to permit one end of the framework to move over the floor when the trolley is being raised or lowered. The patient support member, or the top part of the framework may have side guards, head rests or head and footboards if the stretcher trolley is to be used as a bed in a hospital. It will be seen that a bed constructed so as to be capable of being raised and lowered and/or tilted will be useful in hospitals for treating the patient in the ward.

In addition to, or in place of the side guards, side rails may be provided and these side rails are preferably slidable from one end of the trolley to the other. Such rails can be used for attaching various surgical equipment to the trolley and the fact that the rails slide enables the equipment to be correctly positioned.

It will be understood that an important preferred feature of this invention is that the stretcher trolley has no metal struts passing underneath a large central portion of the patient support member. Thus if the support member is made of X-ray permeable material the patient can be X-rayed on the trolley since no metal will interfere with the X-ray picture.

What is claimed is:

1. A stretcher trolley comprising a patient support member; a rectangular framework for receiving said support member; a pair of rectangular subframes each pivotably attached at one end to said framework at an off-center position at either side of the center-line of said framework; a pair of wheeled, triangular carriages each pivotably connected to the other end of each of said subframes; and two pair of fluid springs, each spring attached at one end intermediate the ends of said subframes and at its other end to the ends of said framework.

* * * * *